US010689773B2

(12) United States Patent
Whitaker et al.

(10) Patent No.: US 10,689,773 B2
(45) **Date of Patent: *Jun. 23, 2020**

(54) PROPERTY MODULATED MATERIALS AND METHODS OF MAKING THE SAME

(71) Applicant: Modumetal, Inc., Seattle, WA (US)

(72) Inventors: John D. Whitaker, Seattle, WA (US); Zhi Liang Bao, Coquitlam (CA)

(73) Assignee: MODUMETAL, INC., Seattle, WA (US)

( * ) Notice: Subject to any disclaimer, the term of this patent is extended or adjusted under 35 U.S.C. 154(b) by 289 days.

This patent is subject to a terminal disclaimer.

(21) Appl. No.: 15/902,938

(22) Filed: Feb. 22, 2018

(65) Prior Publication Data

US 2018/0245229 A1 Aug. 30, 2018

Related U.S. Application Data

(63) Continuation of application No. 14/991,719, filed on Jan. 8, 2016, now Pat. No. 9,938,629, which is a (Continued)

(51) Int. Cl.
*C25D 5/10* (2006.01)
*C25D 5/18* (2006.01)
(Continued)

(52) U.S. Cl.
CPC ..... *C25D 5/10* (2013.01); *C25D 3/20* (2013.01); *C25D 3/665* (2013.01); *C25D 5/16* (2013.01); *C25D 5/18* (2013.01); *C25D 17/10* (2013.01)

(58) Field of Classification Search
CPC ..... C25D 5/10; C25D 5/16; C25D 5/18
See application file for complete search history.

(56) References Cited

U.S. PATENT DOCUMENTS 2,470,775 A 5/1949 Jernstedt et al.
2,642,654 A 6/1953 Ahrens
(Continued)

FOREIGN PATENT DOCUMENTS

EP 1 826 294 A1 8/2007
JP S47-002005 2/1972
(Continued)

OTHER PUBLICATIONS

Aizenberg et al., "Skeleton of *Euplectella* sp.: Structural Hierarchy from the Nanoscale to the Macroscale," *Science* 309:275-278, 2005.
(Continued)

*Primary Examiner* — Brian W Cohen
(74) *Attorney, Agent, or Firm* — Seed Intellectual Property Law Group LLP

(57) ABSTRACT

A method of making property modulated composite materials includes depositing a first layer of material having a first microstructure/nanostructure on a substrate followed by depositing a second layer of material having a second microstructure/nanostructure that differs from the first layer. Multiple first and second layers can be deposited to form a composite material that includes a plurality of adjacent first and second layers. By controlling the microstructure/nanostructure of the layers, the material properties of the composite material formed by this method can be tailored for a specific use. The microstructures/nanostructures of the composite materials may be defined by one or more of grain size, grain boundary geometry, crystal orientation, and a defect density.

21 Claims, 6 Drawing Sheets

Grain Size Modulation

Related U.S. Application Data continuation of application No. 13/003,275, filed as application No. PCT/US2009/049832 on Jul. 7, 2009, now Pat. No. 9,234,294.

(60) Provisional application No. 61/078,668, filed on Jul. 7, 2008.

(51) Int. Cl.

| | |
|---|---|
| ***C25D 5/16*** | (2006.01) |
| ***C25D 17/10*** | (2006.01) |
| ***C25D 3/66*** | (2006.01) |
| ***C25D 3/20*** | (2006.01) |

(56) References Cited

U.S. PATENT DOCUMENTS

| | | | |
|---|---|---|---|
| 2,678,909 | A | 5/1954 | Jernstedt et al. |
| 2,694,743 | A | 11/1954 | Ruskin et al. |
| 2,706,170 | A | 4/1955 | Marchese |
| 3,359,469 | A | 12/1967 | Levy et al. |
| 3,549,505 | A | 12/1970 | Hanusa |
| 3,616,286 | A | 10/1971 | Aylward et al. |
| 3,633,520 | A | 1/1972 | Stiglich, Jr. |
| 3,716,464 | A | 2/1973 | Kovac et al. |
| 3,753,664 | A | 8/1973 | Klingenmaier et al. |
| 3,759,799 | A | 9/1973 | Reinke |
| 3,787,244 | A | 1/1974 | Schulmeister et al. |
| 4,053,371 | A | 10/1977 | Towsley |
| 4,107,003 | A | 8/1978 | Anselrode |
| 4,204,918 | A | 5/1980 | McIntyre et al. |
| 4,246,057 | A | 1/1981 | Janowski et al. |
| 4,422,907 | A | 12/1983 | Birkmaier et al. |
| 4,543,803 | A | 10/1985 | Keyasko |
| 4,591,418 | A | 5/1986 | Snyder |
| 4,592,808 | A | 6/1986 | Doubt |
| 4,597,836 | A | 7/1986 | Schaer et al. |
| 4,620,661 | A | 11/1986 | Slatterly |
| 4,652,348 | A | 3/1987 | Yahalom et al. |
| 4,666,567 | A | 5/1987 | Loch |
| 4,702,802 | A | 10/1987 | Umino et al. |
| 4,795,735 | A | 1/1989 | Liu et al. |
| 4,834,845 | A | 5/1989 | Muko et al. |
| 4,839,214 | A | 6/1989 | Oda et al. |
| 4,869,971 | A | 9/1989 | Nee et al. |
| 4,904,543 | A | 2/1990 | Sakakima et al. |
| 4,923,574 | A | 5/1990 | Cohen |
| 5,045,356 | A | 9/1991 | Uemura et al. |
| 5,056,936 | A | 10/1991 | Mahrus et al. |
| 5,079,039 | A | 1/1992 | Heraud et al. |
| 5,156,899 | A | 10/1992 | Kistrup et al. |
| 5,268,235 | A | 12/1993 | Lashmore et al. |
| 5,300,165 | A | 4/1994 | Sugikawa |
| 5,320,719 | A | 6/1994 | Lasbmore et al. |
| 5,326,454 | A | 7/1994 | Engelhaupt |
| 5,352,266 | A | 10/1994 | Erb et al. |
| 5,431,800 | A | 7/1995 | Kirchhoff et al. |
| 5,489,488 | A | 2/1996 | Asai et al. |
| 5,545,435 | A | 8/1996 | Steffier |
| 5,660,704 | A | 8/1997 | Murase |
| 5,738,951 | A | 4/1998 | Goujard et al. |
| 5,798,033 | A | 8/1998 | Uemiya et al. |
| 6,036,832 | A | 3/2000 | Knol et al. |
| 6,071,398 | A | 6/2000 | Martin et al. |
| 6,284,357 | B1 | 9/2001 | Lackey et al. |
| 6,312,579 | B1 | 11/2001 | Bank et al. |
| 6,355,153 | B1 | 3/2002 | Uzoh et al. |
| 6,409,907 | B1 | 6/2002 | Braun et al. |
| 6,461,678 | B1 | 10/2002 | Chen et al. |
| 6,537,683 | B1 | 3/2003 | Staschko et al. |
| 6,547,944 | B2 | 4/2003 | Schreiber et al. |
| 6,739,028 | B2 | 5/2004 | Sievenpiper et al. |
| 6,800,121 | B2 | 10/2004 | Shahin |
| 6,884,499 | B2 | 4/2005 | Penich et al. |
| 6,902,827 | B2 | 6/2005 | Kelly et al. |
| 6,908,667 | B2 | 6/2005 | Christ et al. |
| 6,979,490 | B2 | 12/2005 | Steffier |
| 9,005,420 | B2 | 4/2015 | Tomantschger et al. |
| 9,108,506 | B2 | 8/2015 | Whitaker et al. |
| 9,115,439 | B2 | 8/2015 | Whitaker |
| 9,234,294 | B2 | 1/2016 | Whitaker et al. |
| 9,273,932 | B2 | 3/2016 | Whitaker et al. |
| 9,732,433 | B2 | 8/2017 | Caldwell et al. |
| 9,758,891 | B2 | 9/2017 | Bao |
| 9,938,629 | B2 | 4/2018 | Whitaker et al. |
| 10,253,419 | B2 | 4/2019 | Lomasney |
| 10,472,727 | B2 | 11/2019 | Lomasney |
| 10,513,791 | B2 | 12/2019 | Lomasney et al. |
| 10,544,510 | B2 | 1/2020 | Lomasney |
| 2003/0236163 | A1 | 12/2003 | Chaturvedi et al. |
| 2004/0027715 | A1 | 2/2004 | Hixson-Goldsmith et al. |
| 2004/0031691 | A1 | 2/2004 | Kelly et al. |
| 2004/0067314 | A1 | 4/2004 | Joshi et al. |
| 2004/0154925 | A1 | 8/2004 | Podlaha et al. |
| 2004/0178076 | A1 | 9/2004 | Stonas et al. |
| 2004/0239836 | A1 | 12/2004 | Chase |
| 2005/0205425 | A1 | 9/2005 | Palumbo et al. |
| 2005/0279640 | A1 | 12/2005 | Shimoyama et al. |
| 2006/0135281 | A1 | 6/2006 | Palumbo et al. |
| 2006/0135282 | A1 | 6/2006 | Palumbo et al. |
| 2006/0272949 | A1 | 12/2006 | Detor et al. |
| 2007/0158204 | A1 | 7/2007 | Taylor et al. |
| 2009/0155617 | A1 | 6/2009 | Kim et al. |
| 2009/0283410 | A1 | 11/2009 | Sklar et al. |
| 2012/0118745 | A1 | 5/2012 | Bao |
| 2015/0315716 | A1 | 11/2015 | Whitaker |
| 2015/0322588 | A1 | 11/2015 | Lomasney et al. |
| 2016/0002790 | A1 | 1/2016 | Whitaker et al. |
| 2016/0002813 | A1 | 1/2016 | Lomasney |
| 2017/0191177 | A1 | 7/2017 | Whitaker et al. |
| 2017/0191179 | A1 | 7/2017 | Sklar |
| 2018/0016692 | A1 | 1/2018 | Caldwell et al. |
| 2018/0016694 | A1 | 1/2018 | Bao |
| 2018/0066375 | A1 | 3/2018 | Morgan et al. |
| 2018/0071980 | A1 | 3/2018 | Lomasney et al. |
| 2018/0245229 | A1 | 8/2018 | Whitaker et al. |
| 2019/0309430 | A1 | 10/2019 | Sklar |
| 2019/0360116 | A1 | 11/2019 | Collinson et al. |

FOREIGN PATENT DOCUMENTS

| | | | |
|---|---|---|---|
| JP | S47-33925 | A | 11/1972 |
| JP | S52-109439 | A | 9/1977 |
| JP | S58-193386 | A | 11/1983 |
| JP | S58-197292 | A | 11/1983 |
| JP | S60-97774 | B2 | 5/1985 |
| JP | S61-99692 | A | 5/1986 |
| JP | H06-196324 | A | 7/1994 |
| JP | 2000-239888 | A | 9/2000 |
| JP | 2006-035176 | | 2/2006 |
| JP | 2009-215590 | A | 9/2009 |
| WO | 83/02784 | A1 | 8/1983 |
| WO | 1997/00980 | A1 | 1/1997 |
| WO | 1997/039166 | A1 | 10/1997 |
| WO | 2007/021980 | A2 | 2/2007 |
| WO | 2007/082112 | A2 | 7/2007 |
| WO | 2012/012789 | A1 | 1/2012 |

OTHER PUBLICATIONS

Bartlett et al., "Electrochemical deposition of macroporous platinum, palladium and cobalt films using polystyrene latex sphere templates," *Chem. Commun.*, pp. 1671-1672, 2000.

Gasser et al., "Materials Design for Acoustic Liners: an Example of Tailored Multifunctional Materials," *Advanced Engineering Materials* 6(1-2):97-102, 2004.

Ghanem et al., "A double templated electrodeposition method for the fabrication of arrays of metal nanodots," *Electrochemistry Communications* 6:447-453, 2004.

Keckes et al., "Cell-wall recovery after irreversible deformation of wood," *Nature Materials* 2:810-814, 2003.

Sanders et al., "Mechanics of hollow sphere foams," *Materials Science and Engineering* A347:70-85, 2003.

(56) References Cited

OTHER PUBLICATIONS

Suresh, "Graded Materials for Resistance to Contact Deformation and Damage," *Science* 292:2447-2451, 2001.
Voevodin et al., "Superhard, functionally gradient, nanolayered and nanocomposite diamond-like carbon coatings for wear protection," *Diamond and Related Materials* 7:463-467, 1998.
Wu et al., "Preparation and characterization of superhard $CN_x$/ZrN multilayers," J. Vac. Sci. Technol. A 15(3):946-950, 1997.
Adams et al., "Controlling strength and toughness of multilayer films: A new multiscalar approach," J. Appl. Phys. 74 (2) Jul. 15, 1993, 1015-1021.
Alfantazi et al., "Synthesis of nanocrystalline Zn—Ni alloy coatings", JMSLD5 15(15), 1996, 1361-1363.
Bakonyi et al., "Electrodeposited multilayer films with giant magnetoresistance " (GMR): Progress and problems, Progress in Materials Science 55 (2010) 107-245.
Beattie et al., "Comparison of Electrodeposited Copper-Zinc Alloys Prepared Individually and Combinatorially," J. Electrochem. Soc., 150(11):C802-C806 (Sep. 25, 2003).
Blum, "The Structure and Properties of Alternately Electrodeposited Metals," paper presented at the Fortieth General Meeting of the American Electrochemical Society, Lake Placid, New York, 14 pages (Oct. 1, 1921).
Cohen et al., "Electroplating of Cyclic Multilayered Alloy (CMA) Coatings," J. Electrochem. Soc., vol. 130, No. 10, Oct. 1983, pp. 1987-1995.
Cowles, "High cycle fatigue in aircraft gas turbines—an industry perspective," International Journal of Fracture, Apr. 1996, vol. 80, Issue 2-3, pp. 147-163, Abstract, 5 pages.
Grimmett et al., "Pulsed Electrodeposition of Iron-Nickel Alloys", J. Electrochem. Soc., vol. 137, No. 11, Nov. 1990 3414-3418.
Hariyanti, "Electroplating of Cu—Sn Alloys and Compositionally Modulated Multilayers of Cu—Sn—Zn—Ni Alloys on Mild Steel Substrate," Thesis (Jun. 2007).
Igawa et al., "Fabrication of SiC fiber reinforced SiC composite by chemical vapor infiltration for excellent mechanical properties," Journal of Physics and Chemistry of Solids 66 (2005) 551-554.
Jeong et al., "The Effect of Grain Size on the Wear Properties of Electrodeposited Nanocrystalline Nickel Coatings", Scripta Mater. 44 (2001) 493-499.
Jia et al., "*Liga and Micromolding*" Chapter 4, The MEMS Handbook, 2nd edition, CRC Press, Edited by Mohamed Gad-el-Hak (2006).
Kaneko et al., "Vickers hardness and deformation of Ni/Cu nano-multilayers electrodeposited on copper substrates," Eleventh International Conference on Intergranular and Interphase Boundaries 2004, Journal of Material Science, 40 (2005) 3231-3236.
Karimpoor et al., "Tensile Properties of Bulk Nanocrystalline Hexagonal Cobalt Electrodeposits", Materials Science Forum, vols. 386-388 (2002) pp. 415-420.
Kockar et al., "Effect of potantiostatic waveforms on properties of electrodeposited NiFe alloy films," Eur. Phys. J. B, 42, 497-501 (2004).
Lashmore et al., "Electrodeposited Multilayer Metallic Coatings", Encyclopedia of Materials Science and Engineering, Supp. vol. 1, 1998, 136-140.
Leisner et al., "Methods for electrodepositing composition-modulated alloys," Journal of Materials Processing Technology 58 (1996) 39-44.
Lekka et al., "Corrosion and wear resistant electrodeposited composite coatings," Electrochimica Acta, 50 (2005), pp. 4551-4556.
Lewis et al., "Stability in thin film multilayers and microlaminates: the role of free energy, structure, and orientation at interfaces and grain boundaries", Scripta Materialia 48 (2003) 1079-1085.
Low et al., "Electrodeposition of composite coatings containing nanoparticles in a metal deposit," Surface & Coatings Technology 201 (2006) 371-383.
"Low-temperature iron plating," web blog article found at http://blog.sina.com.cn/s/blog_48ed0a9c01100024z.html (published Mar. 22, 2006) (English translation attached).
Marchese, "Stress Reduction of Electrodeposited Nickel," Journal of the Electrochemical Society, vol. 99, No. 2, Feb. 1, 1952, p. 39-43.
Meng et al., Fractography, elastic modulus, and oxidation resistance of Novel metal-intermetallic Ni/$Ni_3Al$ multilayer films, J. Mater. Res., vol. 17, No. 4, Apr. 2002, 790-796.
Naslain et al., "Synthesis of highly tailored ceramic matrix composites by pressure-pulsed CVI," Solid State Ionics 141-142 (2001) 541-548.
Naslain, "The design of the fibre-matrix interfacial zone in ceramic matrix composites," Composites Part A 29A (1998) 1145-1155.
Nicholls, "Advances in Coating Design for High-Performance Gas Turbines", MRS Bulletin, Sep. 2003, 659-670.
Pilone et al., "Model of Multiple Metal Electrodeposition in Porous Electrodes," Journal of the Electrochemical Society, 153 (5) D85-D90 (2006).
Podlaha et al. "Induced Codeposition : 1. An Experimental Investigation of Ni—Mo Alloys," J. Electrochem. Soc., 143(3):885-892 (1996).
Ross, "Electrodeposited Multilayer Thin Films," *Annual Review ofMaterials Science*, 24:159-187 (1994).
Sartwell et al., "Replacement of Chromium Electroplating on Gas Turbine Engine Components Using Thermal Spray Coatings", Naval Research Laboratory, Jul. 20, 2005, 207 pages.
Schwartz, "Multiple-Layer Alloy Plating", ASM Handbook, vol. 5: Surface Engineering, 1994, 274-276.
Sherik, "Synthesis, Structure and Properties of Electrodeposited Bulk Nanocrystalline Nickel", Thesis, 1993, 176 pages.
Sperling et al., "Correlation of stress state and nanohardness via heat treatment of nickel-aluminide multilayer thin films", J. Mater. Res., vol. 19, No. 11, Nov. 2004, 3374-3381.
Switzer et al., "Electrodeposited Ceramic Superlattices," Science, vol. 247 (Jan. 26, 1990) 444-446.
Tench et al., "Considerations in Electrodeposition of Compositionally Modulated Alloys," J. Electrochem. Soc. vol. 137, No. 10, Oct. 1990, pp. 3061-3066.
Vill et al., "Mechanical Properties of Tough Multiscalar Microlaminates," Acta metal. mater. vol. 43, No. 2, pp. 427-437, 1995.
Weil et al., "Pulsed electrodeposition of layered brass structures", Metallurgical and Materials Transactions, vol. 19, No. 6, Jun. 1, 1988, 1569-1573.
Yahalom et al., "Formation of composition-modulated alloys by electrodeposition," Journal of Materials Science 22 (1987) 499-503.
Yang et al., "Effects of SiC sub-layer on mechanical properties of Tyranno-Sa/SiC composites with multiple interlayers," Ceramics International 31 (2005) 525-531.
Yang et al., "Enhanced elastic modulus in composition-modulated gold-nickel and copper-palladium foils," Journal of Applied Physics, vol. 48, No. 3, Mar. 1977, 876-879.
Zabludovsky et al., "The Obtaining of Cobalt Multilayers by Programme-Controlled Pulse Current," Transactions of the Institute of Metal Finishing, Maney Publishing, Birmingham, GB, vol. 75, Part 05, Sep. 1, 1997, p. 203-204.
U.S. Appl. No. 16/346,843, filed May 1, 2019.
U.S. Appl. No. 16/396,925, filed Sep. 23, 2019.
U.S. Appl. No. 16/582,931, filed Sep. 25, 2019.
U.S. Appl. No. 16/606,723, filed Oct. 18, 2019.
U.S. Appl. No. 16/671,104, filed Oct. 31, 2019.
U.S. Appl. No. 16/726,079, filed Dec. 23, 2019.

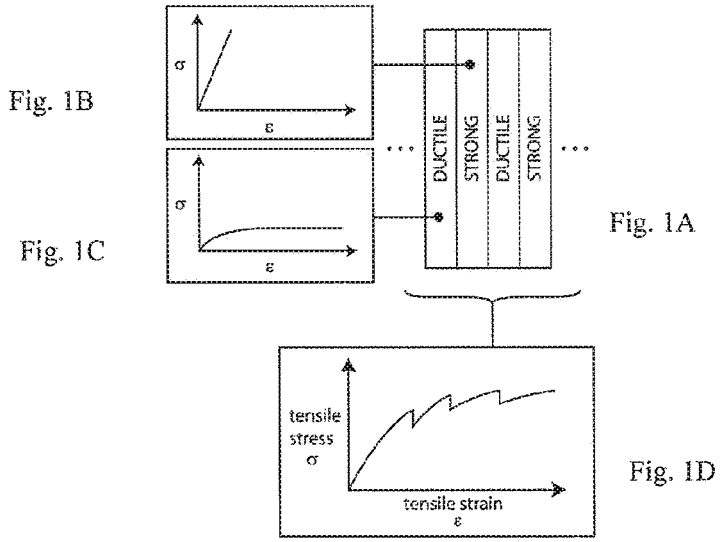
Figs. 1A-1D. Illustration of strong/ductile modulation for improved composite performance.
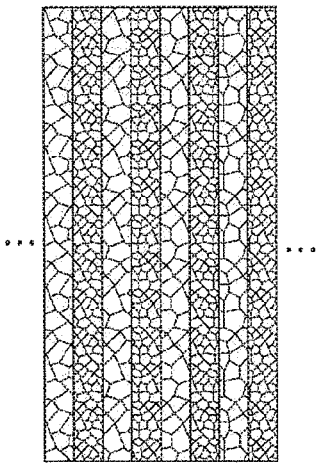
Fig. 2. Grain Size Modulation

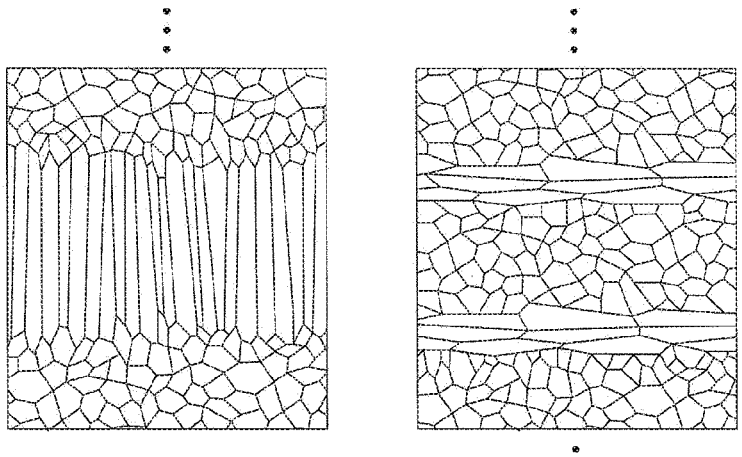
Fig. 3A Fig. 3B
Figs 3A and 3B. Two examples of materials exhibiting modulated grain geometries.
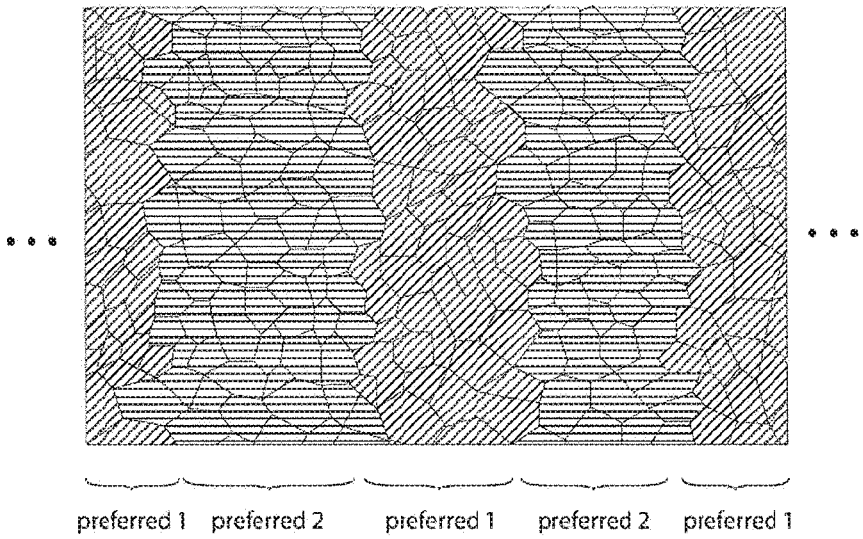
Fig. 4. Example of NMC whose layers alternate between two different preferred orientations.

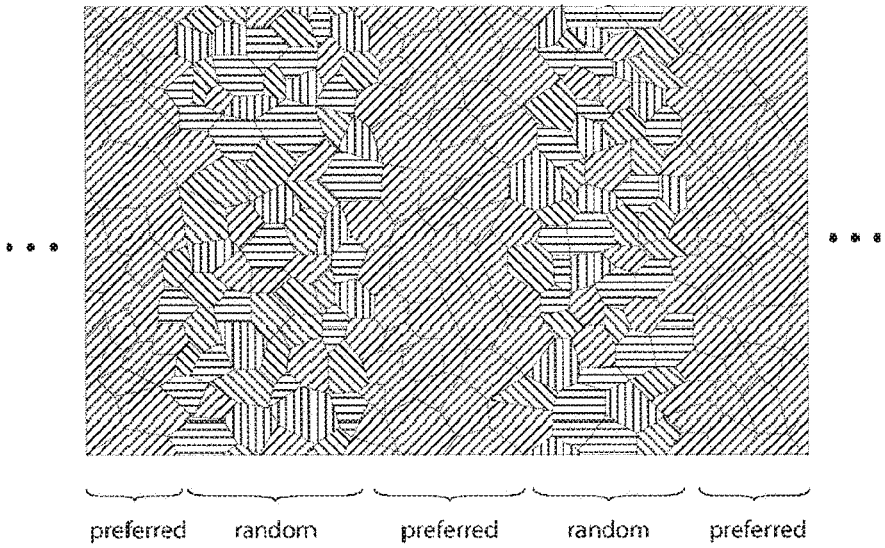
Fig. 5. Example of NMC whose layers alternate between preferred and random orientations.
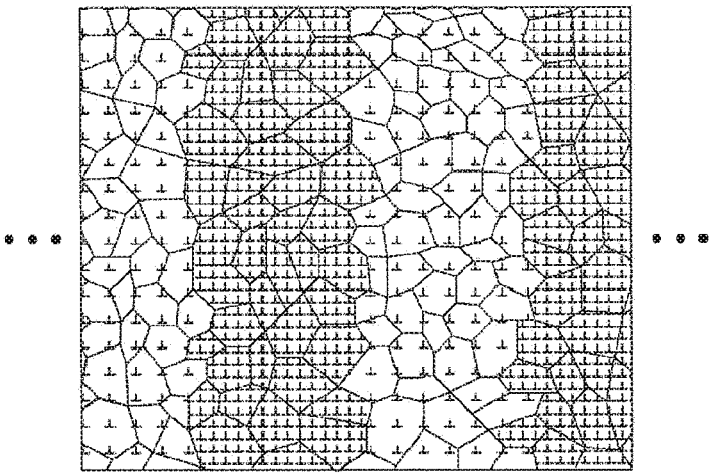
Fig. 6. Example of material whose layers possess alternating high and low defect densities.

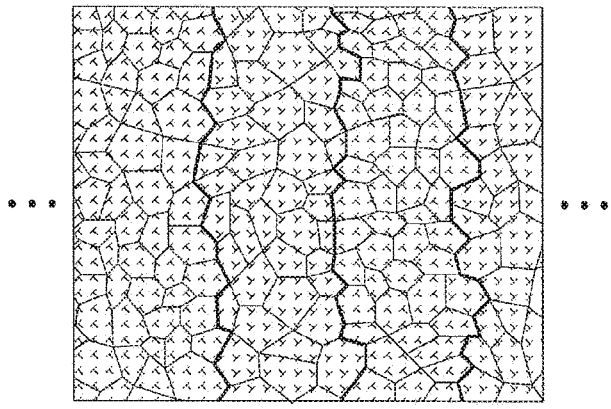
Fig. 7. Example of material whose layers possess defects of opposite sign (borders between layers are highlighted for clarity).
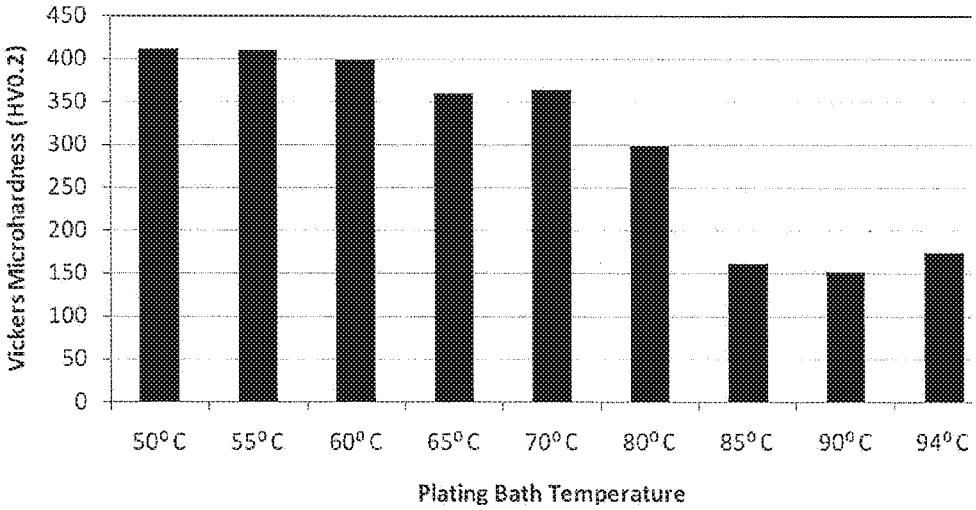
Figure 8: graph of Vicker's Microhardness versus Plating Bath Temperature

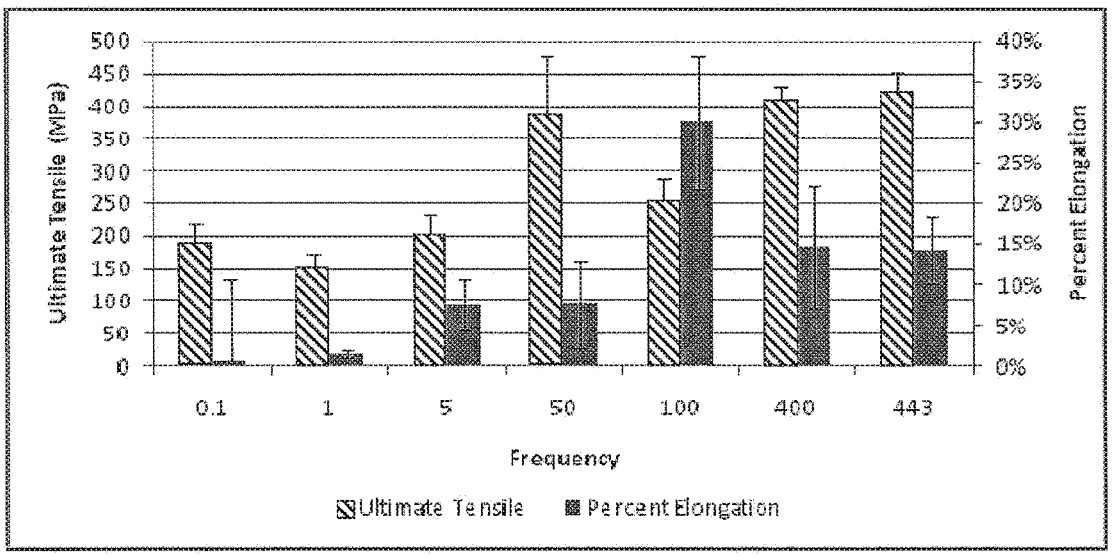
Figure 9: graph of ultimate tensile Strength/Percentage of Elongation versus frequency for an electrodeposit

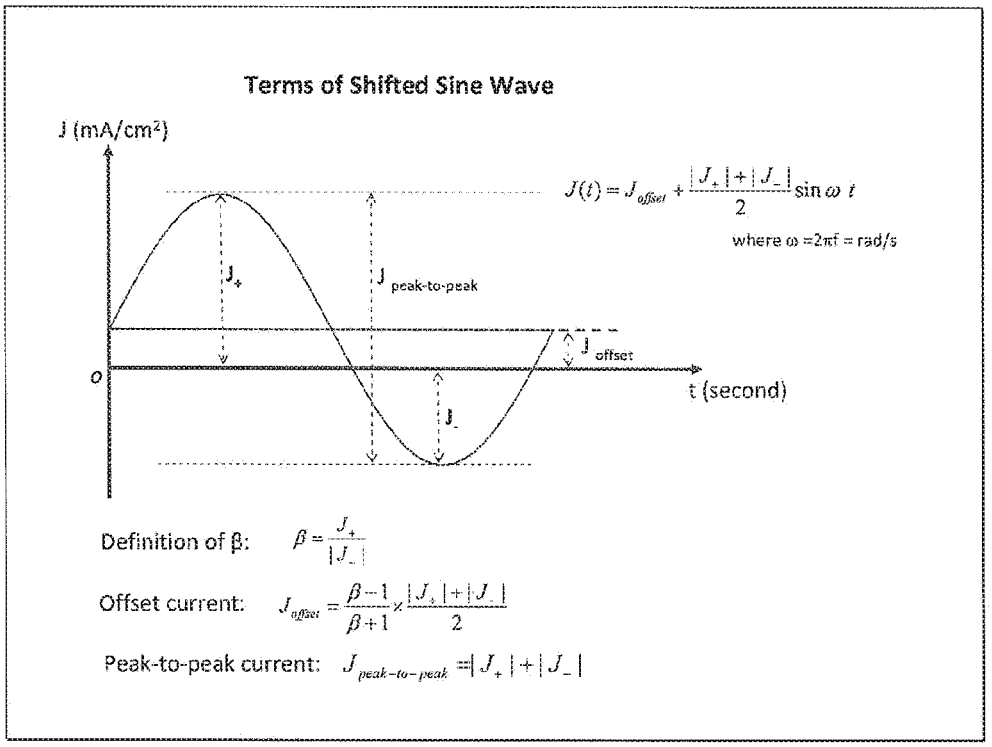
Fig. 10 illustration of terminology used to describe shifted sine wave.

PROPERTY MODULATED MATERIALS AND METHODS OF MAKING THE SAME

FIELD OF THE DISCLOSURE

The disclosure relates generally to layered, such as, for example, nanolayered, or graded materials and methods of making them. The disclosure also relates generally to articles produced from the layered or graded materials.

BACKGROUND

In general, today's advanced material applications are subjected to environments and stresses, which benefit from combinations of material properties. For example, in ballistic applications, a material is sought which is lightweight and thus fuel efficient, while at the same time provides great impact absorption properties to prevent injury or mechanical failure to an underlying structure that may be the target of shrapnel or an exploding device. In aircraft or seacraft applications, materials that are strong, light-weight and at the same time corrosion resistant are also sought. In an attempt to achieve these and other material property combinations, composite materials (i.e., multiphase materials) are employed.

There are many types of composite materials. For example, particle-reinforced composite materials, fiber-reinforced composite materials, structural composite materials or layered composite materials are generally well-known. Each type of composite material can include two or more phases wherein one phase makes up the majority of the material and is know as the matrix material and the second phase (and potentially additional phases) make(s) up a lesser extent of the composite and can be dispersed within the matrix material or layered within the matrix material to form a sandwich. The presence of the second and additional phases affects the material properties (such as, for example, the mechanical and thermal properties) of the composite material. That is, the material properties of the composite material are dependent upon the material properties of the first phase and the second phase (and additional phases) as well as the amounts of the included phases forming the composite. Thus, material properties of a composite can be tailored for a specific application by the selection of specific concentrations of the phases, as well as potentially, the sizes, shapes, distribution, and orientation of the included phases.

Difficulties in the formation, durability, and tailoring of material properties have however impeded or prevented the use of composite materials in some applications. For example, material failure may be due, at least in part, to abrupt property changes along phase interfaces.

Glossary and Summary

The following terms are used throughout this disclosure.

"Composite" is a material including two or more distinct characteristics or phases. For example, a material which includes a layer or zone of a first microstructure/nanostructure together with a layer or a zone of a second or different microstructure/nanostructure is considered a composite for purposes of this disclosure.

"Property Modulated Composite" defines a material whose structural, mechanical, thermal, and/or electrical properties can be represented by a period function of one or more space coordinates, such as, for example, a growth direction of the material.

"Electrodeposition" defines a process in which electricity drives formation of a deposit on an electrode at least partially submerged in a bath including a component or species, which forms a solid phase upon either oxidation or reduction.

"Electrodepositable Species" defines constituents of a material deposited using electrodeposition. Electrodeposited species include metal ions forming a metal salt, as well as particles which are deposited in a metal matrix formed by electrodeposition. Polymers, metal oxides, and intermetallics can also be electrodeposited.

"Waveform" defines a time-varying signal.

The present disclosure relates to property modulated materials. More particularly, the present disclosure relates to a material electrodeposited to include layers or zones of property modulated bulk material. Property modulation is achieved through nanostructure and microstructure (collectively referred to herein as "nanostructure") modulation during a deposition process. These "Nanostructure Modulated Composites" (NMCs) are comprised of layers with distinct nanostructures (each nanostructure has its own distinct phase to faun a composite), where the nanostructure may be defined by grain size (i.e., average grain size), grain orientation, crystal structure, grain boundary geometry, or a combination of these. That is, the NMCs are formed from a single bulk material (e.g., Fe, an alloy of Ni and Fe, a polymer, a metal including ceramic particles) deposited to include adjacent layers which have a distinct nanostructure (e.g., a first layer of large grain size Fe adjacent to a second layer including small grain size Fe).

"Nanostructure Graded Composites" (NGCs) are materials which display a nanostructure gradient in a given direction. NGCs are similar to NMCs except that the nanostructured layers in the latter case are diffuse in a NGC so that there are no distinct interfaces between layers. That is, instead of having distinct layers, NGCs have diffuse or combination regions between sections or zones defined by a particular nanostructure.

In embodiments, the present disclosure provides an electrodeposition process to produce NMCs and NMGs. In embodiments, a layered material can be created by varying the appropriate electrodeposition parameter at predetermined intervals during the course of deposition.

Embodiments described herein provide processes for the production of NMC and NGC having predetermined layers or gradients.

Embodiments described herein also provide property modulated alloys comprising layers in which each layer has a distinct mechanical or thermal property and where that distinct property is achieved by controlling the nanostructure of the layer during deposition.

Embodiments described herein also provide bulk materials produced from NMCs and/or NGCs, where the bulk materials have overall mechanical, thermal, and/or electrical properties that are achieved as a result of the combined mechanical, thermal, and/or electrical properties of the individual layers comprising the NMC and/or NGC.

Other embodiments provide articles produced from NMCs and/or NGCs, where the articles have overall mechanical, thermal, and electrical properties that are achieved as a result of the combined mechanical, thermal, and electrical properties of the individual layers comprising the NMC and/or NGC.

Other embodiments provide NMCs and NGCs comprising a plurality of alternating layers of at least two distinct microstructures in which at least one microstructure layer thickness is varied in a predetermined manner over the overall thickness of the alloy.

Embodiments described herein also provide processes for production of continuously graded alloys in which the relative concentrations of specific microstructure elements (such as grain size, crystal orientation or number of dislocation sites) varies throughout the thickness of the alloy. Such alloys may be produced, for example, by slowly changing the appropriate electrodeposition parameter (such as, for example temperature) during deposition rather than by rapidly switching from one deposition condition (in this case temperature), to another.

In NMCs and NGCs, properties of commercial interest may be achieved by varying the layer thickness and structure. For example, by electroforming a metal or an alloy whose microstructure varies from amorphous (single nanometer grains) to crystalline (multi-micron size grains) a material may be created having a predetermined gradient in hardness.

In general, in one aspect, embodiments herein provide methods for producing a property modulated composite utilizing electrodeposition. The method includes providing a bath including at least one electrodepositable species; providing a substrate upon which the at least one electrodepositable species is to be electrodeposited; at least partially immersing said substrate into the bath; and changing one or more plating parameters in predetermined durations between a first value and a second value. The first value produces a first material having a first composition and a first nanostructure defined by one or more of a first average grain size, a first grain boundary geometry, a first crystal orientation, and a first defect density. The second value produces a second material having a second composition and a second nanostructure defined by one or more of a second average grain size, a second grain boundary geometry, a second crystal orientation, and a second defect density, wherein the first and second compositions are the same, while the first nanostructure differs from the second nanostructure. (That is, one or more of the first average grain size, first grain boundary geometry, first crystal orientation and first defect density differs from the second average grain size, second grain boundary geometry, second crystal orientation and second defect density.)

Such embodiments can include one or more of the following features. The one or more plating parameters utilized in the methods can be selected from the group consisting of temperature, beta (13), frequency, peak to peak current density, average current density, duty cycle, and mass transfer rate. In embodiments, the more than one plating parameters can be changed between the first value and the second value. For example, two or more (e.g., 2, 3, 4) plating parameters can be changed. In one embodiment, both beta and temperature are changed (e.g., plating parameters β1, T1 are utilized during a first period of time and β2, T2 are utilized during a second period of time). More than two values of the plating parameters can be utilized in methods in accordance with the disclosure. For example, in a method in which temperature (T) is varied, the method may apply two or more (e.g., 2, 3, 4, 5, 6, etc.) values of temperature (e.g., T1, 12, T3, T4, T5, T6) can be utilized. The changing of the one or more plating parameters between a first value and the second value can include varying the one or more plating parameters as a continuous function of time (i.e., as a waveform, such as a sine wave, a triangle wave, a sawtooth wave, a square wave, and combination thereof). The first and second materials can be one or more of a metal (e.g., nickel, iron, cobalt, copper, zinc, manganese, platinum, palladium, hafnium, zirconium, chromium, tin, tungsten, molybdenum, phosphorous, barium, yttrium, lanthanum, rhodium, iridium, gold and silver), a metal oxide, a polymer, an intermetallic, a ceramic (e.g., tungsten carbide) and combinations thereof. The method can be utilized to produce a layered property modulated composite. Alternatively, the method can be used to produce a graded property modulated composite. In these property modulated composites the layers (for layered) or sections (for graded) include different mechanical properties, thermal properties, and/or electrical properties between adjacent layers or sections. For example in a layered property modulated composite, a first layer can include a first mechanical property (such as, for example, a high hardness, low ductility) and a second layer can include a second mechanical property (such as, for examples, low hardness, but high ductility). Examples of mechanical properties which can differ between layers or sections include, for example, hardness, elongation, tensile strength, elastic modulus, stiffness, impact toughness, abrasion resistance, and combinations thereof. Examples of thermal properties which can differ between layers or sections include, coefficient of thermal expansion, melting point, thermal conductivity, and specific heat. For the layered property modulated composites, each layer has a thickness. The thickness of the layers can be within the nanoscale to produce a nanolaminate (e.g., thickness of each layer is about 1 nm to about 1,000 nm, 10 nm to 500 nm, 50 nm to 100 nm thick, 1 n, to 5 nm). Each layer in the nanolaminate can be substantially similar in thickness. Alternatively, the thickness of the layers can vary from one layer to the next. In some embodiments, the thicknesses are greater than 1,000 nm (e.g., 2,000 nm, 5,000 nm, 10,000 nm).

An advantage of embodiments described herein is the control of the mechanical and thermal properties of a material (e.g., mechanical properties, thermal properties) by tailoring inter-grain boundaries or grain boundary orientations. For example, by modulating the orientation and grain geometry at the grain boundaries, a bulk material may be produced which resists deformation in several ways. For example, without wishing to be bound by theory, it is believed that in structures that contain large, aligned crystals, slippage will occur, resulting in a ductile material. In another example, by interleaving layers comprising amorphous microstructures or polycrystalline structures, a harder and more brittle layer may be realized. These layers may be very strong and may serve as "waiting elements" in the bulk material. The result may be a material that is both strong and ductile.

Another advantage of embodiments described herein is control of a failure mode of a material by changing the grain orientation in one layer to another orientation in the next layer in order to prevent defect or crack propagation. For example, polycrystals tend to cleave on specific planes on which cracks grow easily. Changes in the grain boundary plan orientation may be introduced from one layer to the next, which may prevent or at least retard cracks from propagating through the material.

Another advantage of embodiments described herein is control of mechanical, thermal, and/or electrical properties of a material by tailoring atomic lattice dislocations within the grains. It is believed that in structures that contain a large number of lattice dislocations, premature failure may occur and the material may not reach its theoretical strength. In a graded or laminated structure, materials with differing or un-aligned dislocations may be layered together to form a material that may approach its theoretical strength.

Another advantage of embodiments described herein is control of plastic deformation (i.e. the behavior of dislocations) near layer boundaries. In a material where the microstructure is laminated, such plastic deformations may be distributed over a larger volume element, thereby reducing the possibility of crack formation or stress pile-up.

Another advantage of embodiments described herein is the ability to tailor thermal conductivity in an NMC or NGC material. For example, by depositing materials in layers which vary from one crystal orientation or phase to another crystal orientation or phase of the material, and where the layers have thickness on the order of the phonon or electron mean free path or coherence wavelength of the material, a change in thermal conductivity can be realized.

Another advantage of embodiments described herein is the ability to tailor electrical conductivity in an NMC or NGC material. For example, by depositing materials in layers or in graded sections which vary the dislocation density within the grains, the electrical conductivity of the material can be altered.

BRIEF DESCRIPTION OF THE DRAWINGS

The drawings are not necessarily to scale; the emphasis instead being placed upon illustrating the principles of the disclosure.

FIG. 1A is an illustration of alternating strong layers and ductile layers to form a composite.

FIG. 1B illustrates the stress versus strain curve for an individual strong layer. FIG. 1C illustrates the stress versus strain layer for an individual ductile layer. FIG. 1D illustrates the stress versus strain curve showing improved performance of the composite (combination of strong and ductile layers).

FIG. 2 is an illustration of a composite including grain size modulation.

FIG. 3A is an illustration of a composite including modulated grain boundary geometry. FIG. 3B is an illustration of another composite including modulated grain boundary geometry.

FIG. 4 is an illustration of an NMC in accordance with the present disclosure that includes layers that alternate between two different preferred orientations.

FIG. 5 is an illustration of another NMC whose layers alternate between preferred and random orientations.

FIG. 6 is an illustration of another NMC whose layers possess alternating high and low defect densities.

FIG. 7 is an illustration of another NMC whose layers possess defects of opposite sign. The borders between the layers are darkened for clarity.

FIG. 8 is a graph of Vicker's microhardness versus plating bath temperature for an iron (Fe) material electrodeposited in accordance with the present disclosure.

FIG. 9 is a graph of ultimate tensile strength and percentage of elongation versus frequency for an electrodeposited Fe in accordance with the present disclosure.

FIG. 10 is an illustration of terminology that may be used to describe a sine wave function used to control the current density in the electrodeposition/electroformation process. Positive values of J (current density) are cathodic and reducing, whereas negative values are anodic and oxidizing. For net electrodeposition to take place with a sine wave function the value of β must be greater than one (i.e. $J_{offset}$ must be greater than one).

DETAILED DESCRIPTION

1. Modulation of Properties

In one embodiment, property modulated composites are provided comprising a plurality of alternating layers, in which those layers have specific mechanical properties, such as, for example, tensile strength, elongation, hardness, ductility, and impact toughness, and where the specific mechanical properties are achieved by altering the nanostructure of those layers. This embodiment is illustrated in FIGS. 1A-1D.

In general, tensile strength may be controlled through controlling frequency of a signal used for electrodepositing a material. In general, percentage of elongation of a material can also be controlled through frequency. In general, hardness, ductility, and impact toughness can be controlled through controlling deposition temperature. Other methods for controlling tensile strength, elongation, hardness, ductility and impact toughness are also envisioned.

Another embodiment provides property modulated composite comprising a plurality of alternating layers, in which those layers have specific thermal properties, such as thermal expansion, thermal conductivity, specific heat, etc. and where the specific thermal properties are achieved by altering the nanostructure of those layers.

2. Modulation of Structure

Another embodiment provides NMCs comprising a plurality of alternating layers of at least two nanostructures, in which one layer has substantially one grain size and another layer has substantially another grain size, and where the grain sizes may range from smaller than 1 nanometer to larger than 10,000 nanometers. Such a structure is illustrated in FIG. 2. Smaller grain sizes, which can range, e.g., from about 0.5 nanometers to about 100 nanometers, generally will yield layers that generally exhibit high impact toughness. Large grain sizes, which generally will be greater than 1,000 nanometers, such as, for example, 5,000 or 10,000 nanometers and generally will produce layers that provide greater ductility. Of course, the grain sizes will be relative within a given group of layers such that even a grain size in the intermediate or small ranges described above could be deemed large compared to, e.g., a very small grain size or small compared to a very large grain size.

Generally, such grain sizes can be controlled through process parameters, such as, for example deposition temperature (e.g., electrodeposition bath temperature). To modulate grain size utilizing temperature control, a first layer defined by large grains can be formed by increasing the deposition temperature and a second layer defined by smaller grains can be formed by decreasing the temperature. (The material composition does not change between the first and second layers—only the grain size modulates).

The thickness of the individual layers in the NMCs can range from about 0.1 nanometer to about 10,000 nanometers or more. Layer thickness may range from about 5 nanometers to 50 nanometers, although varied thicknesses are expressly envisioned. The NMCs may contain anywhere from 2-10, 10-20, 20-30, 30-50, 75-100, 100-200, or even more layers, with each layer being created with a desired thickness, and nanostructure/microstructure.

When structural modulations are characterized by individual layer thicknesses of 0.5-5 nanometers, it is possible to produce materials possessing a dramatically increased modulus of elasticity, or "supermodulus." The modulated structural trait can include, for example, one or more of grain size, preferred orientation, crystal type, degree of order (e.g., gamma-prime vs. gamma), defect density, and defect orientation.

In another embodiment, NMCs can comprise a plurality of alternating layers of at least two nanostructures, in which one layer has substantially one inter-grain boundary geometry and another layer has substantially another inter-grain boundary geometry, as illustrated in FIGS. 3A and 3B.

In still another embodiment, NMCs can comprise a plurality of alternating layers of at least two nanostructures, in which one layer has substantially one crystal orientation and another layer has substantially another crystal orientation (FIG. 4), or no preferred orientation (FIG. 5).

In still another embodiment, NMCs can comprise a plurality of alternating layers of at least two nanostructures, in which one layer has grains possessing a substantially higher defect density and another layer has grains possessing a substantially lower defect density, an example of which is illustrated schematically in FIG. 6. Similarly, embodiments can include materials whose layers alternate between defect orientation or sign, as illustrated in FIG. 7.

In still another embodiment, NMCs or NGCs can comprise a plurality of alternating layers or diffuse zones of at least two nanostructures. Each layer or zone has a mechanical, thermal, and/or electrical property associated with it, which is a distinct property as compared to an adjacent layer or zone. For example, a NMC can include a plurality of first layers each of which have a Vicker's microhardness value of 400 and a plurality of second layers each of which have a Vicker's microhardness value of 200. The NMC is formed such that on a substrate the first and second layers alternate so that each of the deposited layers has a distinct mechanical property as compared to the layer's adjacent neighbor (i.e., the mechanical properties across an interface between first and second layers are different). In some embodiments, property modulation in Vicker's hardness is created by alternating the deposition temperature in an electrochemical cell. Referring to FIG. 8, the first layers having a Vicker's microhardness value of 400 can be formed by electrodepositing Fe at a temperature 60° C., whereas second layers having a Vicker's microhardness value of 200 can be deposited at a temperature of 90° C.

In other embodiments, mechanical or thermal properties of NMCs or NGCs can be controlled through other deposition conditions such as, for example, frequency of an electrical signal used to electrodeposit layers on a substrate. In general, by increasing the frequency of the signal utilized in electrodeposition of a material, an increase in ductility (e.g., increase in ultimate tensile strength and percentage elongation) can be realized as illustrated in FIG. 9.

In addition to the frequency, the wave form of the electrical signal used to electrodeposit layers can also be controlled. For example, a sine wave, a square wave, a triangular wave, sawtooth, or any other shaped wave form can be used in electrodeposition. In general, the frequency of the waves can very from very low to very high, e.g., from about 0.01 to about 1,000 Hz, with ranges typically being from about 1 to about 400 Hz (e.g., 10 Hz to 300 Hz, 15 Hz to 100 Hz). The current also can be varied. Currents ranging from low to high values are envisioned, e.g., from about 1 to about 400 mA/cm$^2$, with typical ranges being from about 10 to about 150 mA/cm$^2$, in particular, 20 to 100 mA/cm$^2$.

3. Production Processes

One embodiment provides a process for the production of a property modulated composite comprising multiple layers with discrete nanostructures. This process comprises the steps of:

i) providing a bath containing an electrodepositable species (i.e., a species which when deposited through electrodeposition forms a material, such as a metal);

ii) providing a substrate upon which the metal is to be electrodeposited;

iii) immersing said substrate in the bath;

iv) passing an electric current through the substrate so as to deposit the metal onto the substrate; and v) heating and cooling the bath or the substrate according to an alternating cycle of predetermined durations between a first value which is known to produce one grain size and a second value known to produce a second grain size.

Another embodiment provides a process for the production of a property modulated composite comprising multiple layers with discrete nanostructures. This process comprises the steps of:

i) providing a bath containing an electrodepositable species (e.g., a species which forms a metal when electrodeposited);

ii) providing a substrate upon which the metal is to be electrodeposited;

iii) immersing the substrate in the bath; and iv) passing an electric current through the substrate in an alternating cycle of predetermined frequencies between a first frequency which is known to produce one nanostructure and a second frequency known to produce a second nanostructure.

Another embodiment provides a process for the production of a property modulated composite comprising multiple layers with discrete nanostructures. This process comprises the steps of:

i) providing a bath containing an electrodepositable species (e.g., a species which forms a metal when electrodeposited);

ii) providing a substrate upon which the metal is to be electrodeposited;

iii) immersing the substrate in the bath;

iv) passing an electric current through the substrate in an alternating cycle of predetermined frequencies between a first frequency which is known to produce one nanostructure and a second frequency known to produce a second nanostructure, while at the same time heating and cooling the bath or the substrate according to an alternating cycle of predetermined durations between a first value and a second value.

Additional embodiments relate to processes for the production of a material where production parameters may be varied to produce variations in the material nanostructure, including beta, peak-to-peak current density, average current density, mass transfer rate, and duty cycle, to name a few.

In embodiments, the bath includes an electrodepositable species that forms an iron coating/layer or an iron alloy coating/layer. In other embodiments, the bath includes an electrodepositable species that forms a metal or metal alloy selected from the group consisting of nickel, cobalt, copper, zinc, manganese, platinum, palladium, hafnium, zirconium, chromium, tin, tungsten, molybdenum, phosphorous, barium, yttrium, lanthanum, rhodium, iridium, gold, silver, and combinations thereof.

Though the discussion and examples provided herein are directed to metallic materials, it is understood that the instant disclosure is equally applicable for metal oxides, polymers, intermetallics, and ceramics (all of which can be produced using deposition techniques with or without subsequent processing, such as thermal, radiation or mechanical treatment).

EXAMPLES

The following examples are merely intended to illustrate the practice and advantages of specific embodiments of the present disclosure; in no event are they to be used to restrict the scope of the generic disclosure.

Example I

Temperature Modulation

One-dimensionally modulated (laminated) materials can be created by controlled, time-varying electrodeposition conditions, such as, for example, current/potential, mass transfer/mixing, or temperature, pressure, and, electrolyte composition. An example for producing a laminated, grain-size-modulated material is as follows:

1. Prepare an electrolyte consisting of 1.24M $FeCl_2$ in deionized water.
2. Adjust the pH of the electrolyte to −0.5-1.5 by addition of HCl.
3. Heat the bath to 95° C. under continuous carbon filtration at a flow rate of ~2-3 turns (bath volumes) per minute.
4. Immerse a titanium cathode and low-carbon steel anode into the bath and apply a current such that the plating current on the cathode is at least 100 mA/cm$^2$.
5. Raise and lower the temperature of the bath, between 95° C. (large grains) and 80° C. (smaller grains) at the desired frequency, depending on the desired wavelength of grain size modulation. Continue until the desired thickness is obtained.
6. Remove the substrate and deposit from the bath and immerse in deionized (DI) water for 10 minutes.
7. Pry the substrate loose from the underlying titanium to yield a free-standing, grain-size modulated material.

Example II

Beta Modulation

This example involves electroplating NMCs by modulating the beta value. In embodiments where the current density is applied as a sine wave having (1) a peak cathodic current density value ($J_+>0$), (2) a peak anodic current density value ($J_-<0$), and (3) a positive DC offset current density to shift the sine wave vertically to provide a net deposition of material, properties of the deposited layers or sections can be modulated by changing a beta value. (See FIG. 10). The beta value is defined as the ratio of the value of peak cathodic current density to the absolute value of peak anodic current density. At low beta value (<1.3), the electroplated iron layers have low hardness and high ductility, while at high beta (>1.5), the plated iron layers have high hardness and low ductility. The laminated structure with modulated hardness and ductility makes the material stronger than homogeneous material.

The electroplating system includes a tank, electrolyte of $FeCl_2$ bath with or without $CaCl_2$, computer controlled heater to maintain bath temperature, a power supply, and a controlling computer. The anode is low carbon steel sheet, and cathode is titanium plate which will make it easy for the deposit to be peeled, off. Carbon steel can also be used as the cathode if the deposit does not need to be peeled off from the substrate. Polypropylene balls are used to cover the bath surface in order to reduce bath evaporation.

The process for producing an iron laminate is as follows:

1. Prepare a tank of electrolyte consisting of 2.0 M $FeCl_2$ or 1.7 M $FeCl_2$ plus 1.7 $CaCl_2$ in deionized water.
2. Adjust the pH of the electrolyte to −0.5-1.5 by addition of HCl.
3. Control the bath temperature at 60° C.
4. Clean the titanium substrate cathode and low carbon steel sheet anode with deionized water and immerse both of them into the bath.
5. To start electroplating a high ductility layer, turn on the power supply, and controlling the power supply to generate a shifted sine wave of beta 1.26, by setting the following parameters: 250 Hz with a peak current cathodic current density of 43 mA/cm$^2$ and a peak anodic current density of −34 mA/cm$^2$ applied to the substrate (i.e., a peak to peak current density of 78 mA/cm$^2$ with a DC offset of 4.4 mA/cm$^2$). Continue electroplating a for an amount of time necessary to achieve the desired high ductility layer thickness.
6. To continue electroplating a high hardness layer, change the power supply wave form using the computer, with a beta value of 1.6, by setting the following parameters: 250 Hz with a peak current cathodic current density of 48 mA/cm$^2$ and a peak anodic current density of −30 mA/cm$^2$ applied to the substrate (i.e., a peak to peak current density of 78 mA/cm$^2$ with a DC offset of 9.0 mA/cm$^2$). Continue electroplating for an amount of time needed to achieve the desired high hardness layer thickness. (Optionally, the temperature can be decreased to 30° C. during this deposition step to further tailor the hardness of the layer.)
7. Remove the substrate and deposit from the bath and immerse in DI water for 10 minutes and blow it dry with compressed air.
8. Peel the deposit from the underlying titanium substrate to yield a free-standing temperature modulated laminate.

Example III

Example Frequency Modulation

This example describes a process of electroplating NMCs by modulating the frequency of the wave-form-generating power supply. The wave-form can have any shape, including but not limited to: sine, square, and triangular. At low frequency (<1 Hz), the plated iron layers have high hardness and low ductility, while at high frequency (>100 Hz), the electroplated iron layers have low hardness and high ductility. The laminated structure with modulated hardness and ductility makes the material stronger than homogeneous material.

The electroplating system includes a tank, electrolyte of $FeCl_2$ bath with or without $CaCl_2$, computer controlled heater to maintain bath temperature at 60° C., a power supply that can generate wave forms of sine wave and square wave with DC offset, and a controlling computer. The anode is a low carbon steel sheet, and the cathode is a titanium plate which will make it easy for the deposit to be peeled off. Carbon steel can also be used as the cathode if the deposit does not need to be peeled off from the substrate. Polypropylene balls are used to cover the bath surface in order to reduce bath evaporation.

The process for producing an iron laminate is as follows:

1. Prepare a tank of electrolyte consisting of 2.0 M $FeCl_2$ or 1.7 M $FeCl_2$ plus 1.7 $CaCl_2$ in deionized water.
2. Adjust the pH of the electrolyte to −0.5-1.5 by addition of HCl.
3. Control the bath temperature at 60° C.
4. Clean the titanium substrate cathode and low carbon steel sheet anode with deionized water and immerse both of them into the bath.
5. To start electroplating a high ductility layer, turn on the power supply, and controlling the power supply to generate a sine wave having a beta of 1.26, by setting the following parameters: 10-1000 Hz with a peak current cathodic current density of 43 mA/cm$^2$ and a peak anodic current density of −34 mA/cm$^2$ applied to the substrate (i.e., a peak to peak current density of 78 mA/cm$^2$ with a DC offset of 4.4 mA/cm$^2$). Continue electroplating for an amount of time necessary to achieve the desired high ductility layer thickness.

6. To continue electroplating a high hardness layer, change the power supply wave form (shifted sine wave having a beta of 1.26) using the computer, with the following parameters: 1 Hz with a peak current cathodic current density of 43 mA/cm$^2$ and a peak anodic current density of −34 mA/cm$^2$ applied to the substrate (i.e., a peak to peak current density of 78 mA/cm$^2$ with a DC offset of 4.4 mA/cm$^2$). Keep on electroplating for a specific amount of time which is determined by the desired high hardness layer thickness.

7. Remove the substrate and deposit from the bath and immerse in deionized (DI) water for 10 minutes and blow it dry with compressed air.

8. Peel the deposit from the underlying titanium substrate to yield a free-standing temperature modulated laminate.

Possible Substrates

In the examples described above the substrates used are in the form of a solid, conductive mandrel (i.e., titanium or stainless steel). While the substrate may comprise a solid, conductive material, other substrates are also possible. For example, instead of being solid, the substrate may be formed of a porous material, such as a consolidated porous substrate, such as a foam, a mesh, or a fabric. Alternatively, the substrate can be formed of a unconsolidated material, such as, a bed of particles, or a plurality of unconnected fibers. In some embodiments, the substrate is formed from a conductive material or a non-conductive material which is made conductive by metallizing. In other embodiments, the substrate may be a semi-conductive material, such as a silicon wafer The substrate may be left in place after deposition of the NMCs or NGCs or may be removed.

Articles Utilizing NMCs or NGCs

Layered materials described herein can provide tailored material properties, which are advantageous in advance material applications. For example, the NMCs and NGCs described herein can be used in ballistic applications (e.g., body armor panels or tank panels), vehicle (auto, water, air) applications (e.g., car door panels, chassis components, and boat, plane and helicopter body parts) to provide a bulk material that is both light weight and structurally sound. In addition, NMCs and NGC can be used in sporting equipment applications (e.g., tennis racket frames, shafts), building applications (support beams, framing), transportation applications (e.g., transportation containers) and high temperature applications (e.g., engine and exhaust parts).

The invention claimed is:

1. A method, comprising:

contacting a portion of a substrate with a bath including at least two electrodepositable species;

forming a property modulated composite on the portion of the substrate by:

applying a current to the substrate at a first setting having a first determined value of beta for a first duration, beta being defined as a ratio of a value of peak cathodic current density to an absolute value of peak anodic current density, the current having a current density that is a sine waveform, the first setting producing a first material comprising the at least two electrodepositable species, the first material having a first composition and a first nanostructure defined by one or more of a first average grain size, a first grain boundary geometry, a first crystal orientation, and a first defect density; and applying the current to the substrate at a second setting having a second determined value of beta for a second duration, the second setting producing a second material comprising the at least two electrodepositable species, the second material having a second composition and a second nanostructure defined by one or more of a second average grain size, a second grain boundary geometry, a second crystal orientation, and a second defect density, where one or more of the first average grain size differs from the second average grain size, the first grain boundary geometry differs from the second grain boundary geometry, the first crystal orientation differs from the second crystal orientation, or the first defect density differs from the second defect density.

2. The method of claim 1, wherein beta is changed from the first determined value to the second determined value as a continuous function of time.

3. The method of claim 1, wherein the property modulated composite is a layered property modulated composite.

4. The method of claim 3, wherein the layered property modulated composite comprises alternating first and second layers produced by the applying the current to the substrate at the first and second settings.

5. The method of claim 3, wherein a first layer of the layered property modulated composite exhibits a first mechanical property and a second layer of the layered property modulated composite, which is adjacent to the first layer, exhibits a second mechanical property, which differs from the first mechanical property.

6. The method of claim 5, wherein the first mechanical property and the second mechanical property are selected from the group consisting of hardness, elongation, tensile strength, elastic modulus, stiffness, impact toughness, abrasion resistance, and combinations thereof.

7. The method of claim 3, wherein a first layer of the layered property modulated composite exhibits a first thermal property and a second layer of the layered property modulated composite, which is adjacent to the first layer, exhibits a second thermal property, which differs from the first thermal property.

8. The method of claim 7, wherein the first thermal property and the second thermal property are selected from the group consisting of coefficient of thermal expansion, melting point, thermal conductivity, and specific heat.

9. The method of claim 3, wherein the layered property modulated composite includes a plurality of layers, each layer of the plurality of layers having a thickness ranging from about 1 nanometer to about 10,000 nanometers.

10. The method of claim 1, wherein the property modulated composite is a graded property modulated composite.

11. The method of claim 1, wherein the first determined value of beta is less than 1.3 and the second determined value of beta is greater than 1.5.

12. The method of claim 1, wherein the current density has a DC offset.

13. The method of claim 12, wherein the current density has substantially a same DC offset while the current is applied to the substrate.

14. The method of claim 1, wherein the current maintains substantially a same peak cathodic current density and substantially a same peak anodic current density while the current is applied to the substrate.

15. The method of claim 1, wherein the current has substantially a same peak-to-peak current density while the current is applied to the substrate.

16. The method of claim 1, wherein a temperature of the bath is maintained while the current is applied to the substrate.

17. The method of claim 1, wherein the at least two electrodepositable species comprises two or more metals.

18. The method of claim 17, wherein the one or more metals comprise nickel, iron, cobalt, copper, zinc, manganese, platinum, palladium, hafnium, zirconium, chromium, tin, tungsten, molybdenum, phosphorous, barium, yttrium, lanthanum, rhodium, iridium, gold, or silver.

19. The method of claim 18, wherein the two or more metals comprise nickel, iron, zinc, cobalt, chromium, or a combination thereof.

20. The method of claim 1, further comprising removing the property modulated composite from the substrate.

21. The method of claim 1, wherein the current has substantially a same frequency while the current is applied to the substrate.

* * * * *